United States Patent [19]

McMillan et al.

[11] 4,455,844

[45] Jun. 26, 1984

[54] SELF-CLEANING UNDER BASKET LINT FILTER FOR AUTOMATIC WASHERS

[75] Inventors: Stephen L. McMillan; Robert R. Cureton, both of Louisville, Ky.

[73] Assignee: General Electric Company, Louisville, Ky.

[21] Appl. No.: 520,493

[22] Filed: Aug. 4, 1983

[51] Int. Cl.[3] ..... D06F 13/02; D06F 39/10

[52] U.S. Cl. ..... 68/18 F; 210/167

[58] Field of Search ..... 68/23.7, 53, 18 F, 18 FA; 210/167, 196

[56] References Cited

U.S. PATENT DOCUMENTS

| | | | |
|---|---|---|---|
| 2,287,628 | 6/1942 | McMahan | 68/18 F X |
| 2,722,118 | 11/1955 | Guthrie | 68/134 |
| 2,744,402 | 5/1956 | Smith | 68/18 FA X |
| 2,900,812 | 8/1959 | Smith | 68/23 |
| 2,939,305 | 6/1960 | Snyder et al. | 68/18 |
| 2,943,474 | 7/1960 | Bochan | 68/18 |
| 2,961,862 | 11/1960 | Smith | 68/18 |
| 3,335,867 | 8/1967 | Perl | 210/167 |
| 3,352,130 | 11/1967 | Landwier | 68/18 |
| 3,626,728 | 12/1971 | Traube et al. | 68/18 F |
| 3,772,902 | 11/1973 | Noguchi | 68/18 F |
| 3,910,076 | 10/1975 | Ruble | 68/18 F |
| 4,003,225 | 1/1977 | Worst | 68/18 FA |
| 4,075,876 | 2/1978 | Platt | 68/18 F |
| 4,357,813 | 11/1982 | Sherer et al. | 68/18 F |

FOREIGN PATENT DOCUMENTS

| | | | |
|---|---|---|---|
| 1018611 | 1/1966 | United Kingdom | 68/18 F |

*Primary Examiner*—Philip R. Coe
*Assistant Examiner*—Frankie L. Stinson
*Attorney, Agent, or Firm*—Frank P. Giacalone; Radford M. Reams

[57] ABSTRACT

A filter attached for rotation with a washing machine basket includes a filtering surface which is in a plane substantially perpendicular to the axis of the basket for filtering laundry liquid during a washing operation and for reverse flushing of the filtering surface during a liquid extraction operation.

1 Claim, 3 Drawing Figures

SELF-CLEANING UNDER BASKET LINT FILTER FOR AUTOMATIC WASHERS

BACKGROUND OF THE INVENTION

This invention relates to automatic washing machines of the vertical axis type and more particularly to a filter system for such automatic washing machines.

Because of mechanical agitation to which articles of clothing are subjected in the conventional washing machine, and the resulting flexing and turnovers of the fabrics, a very appreciable amount of short fibers or lint is separated from the fabrics. This lint remains in suspension in the water, and during centrifugal extraction of the washing liquid following the washing of clothes, much of the lint will remain trapped or be redeposited on the articles of clothing. Even though automatic washing machines generally include subsequent rinsing operations, it has been found that much of the lint is retained in the rinsing water and, unless removed from the circulating wash water, it is again trapped in the articles of clothing during the final extraction of the water.

U.S. Pat. No. 4,357,813 discloses a truncated filter cone constructed of a rigid material such as polypropylene fastened beneath the bottom of a clothes basket. The filter cone comprises a generally truncated conical shape which is positioned adjacent the bottom wall of the basket near the upper end of the cone and is spaced from the bottom wall of the basket at the lower end of the cone. The lower end or periphery of the cone has upwardly and outwardly extending rigid teeth spaced closely subjacent the bottom wall of the basket along a generally circular line.

As a pumping agitator mounted in the basket draws liquid along a path radially inwardly from the periphery of the tub sump beneath the basket, lint carried by the liquid is trapped on and between the teeth of the filter cone. The liquid is drawn through apertures in the bottom wall of the basket and into the basket through the agitator. The liquid then flows outwardly toward the sump to repeat the cycle.

During the direct-into-spin portion of the cycle, a pressure differential is established by the spinning of the basket, tending to cause laundry liquid to flow back into the basket through the openings in the bottom wall. During this portion of the cycle, the rotating rigid filter teeth provide a pumping action to oppose this flow and along with the conical shape of the filter prevent sand or sediment from returning to the basket to be deposited on the clothing.

As the water level within the tub is decreased by the drain pump, the pumping action of the filter teeth causes water to flow outwardly from the basket through the openings in the bottom of the basket, thereby automatically cleaning the filter teeth. The lint then moves to drain from the tub along with the laundry liquid, thus automatically effecting a cleaning of the filter without manual intervention.

SUMMARY OF THE INVENTION

The present invention relates to a washing machine of the vertical axis type including a stationary outer imperforate tub having a side wall and a bottom wall for containing a liquid, and a basket mounted in the tub on the vertical axis for containing articles to be washed. The basket is formed with a perforated side wall and a lower wall sloping upwardly from a lower outer portion located adjacent the bottom wall of the tub. Formed on the lower wall of the basket are a plurality of circumferentially spaced openings that are spaced from the vertical axis. Mounted in said basket on the vertical axis for rotation relative to said basket is an agitator. A drive arrangement is provided for spinning the basket during a liquid extraction operation and for oscillating the agitator during a washing operation. More particularly the invention relates to a filtering system wherein a filter is mounted for rotation with the basket in spaced relationship with the lower wall of the basket and adjacent the lower wall of the tub.

The filter is disk-shaped and is provided with a circumferentially disposed, relatively flat filtering surface arranged in a plane substantially perpendicular to the axis. The filtering surface has formed thereon a plurality of apertures dimensioned for removing lint from circulating liquid during the washing operation.

The agitator is formed to include a liquid impelling means comprising a plurality of radially projecting vanes located radially outwardly from the circumferentially spaced openings with the area between the agitator and the lower wall of the basket defining a pump means in the basket for causing liquid circulating during the washing operation to flow upwardly from the tub through the filtering apertures and into the basket through the circumferentially spaced openings to thereby prevent lint from returning to the basket. The filter is formed to include a liquid impelling means comprising a plurality of radially projecting vanes located between the filter and the lower wall of the basket. The radially disposed vanes are located radially outwardly from the circumferentially spaced openings in the basket bottom wall with the space between the filter and bottom wall of the basket defining a pump means for causing liquid during the extraction operation to flow downwardly from the basket through the circumferentially spaced openings and the filtering means for backflushing and removing lint from the filtering surface. The horizontally disposed flat filtering surface which is generally parallel to the bottom wall of the tub allows the shearing force between the spinning basket and the liquid in the tub bottom to effectively remove lint from the filtering surface during the initial portion of the extraction operation.

DESCRIPTION OF THE PREFERRED EMBODIMENT

Figure 1:
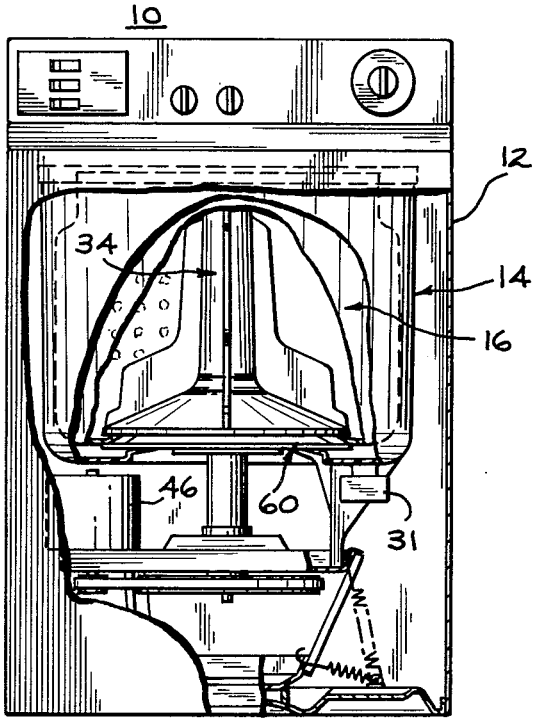
FIG. 1 is a front elevational view of a vertical axis clothes washing machine including the recirculation and filtering system embodying the present invention, the view being partially broken away in order to illustrate details.
Figure 3:
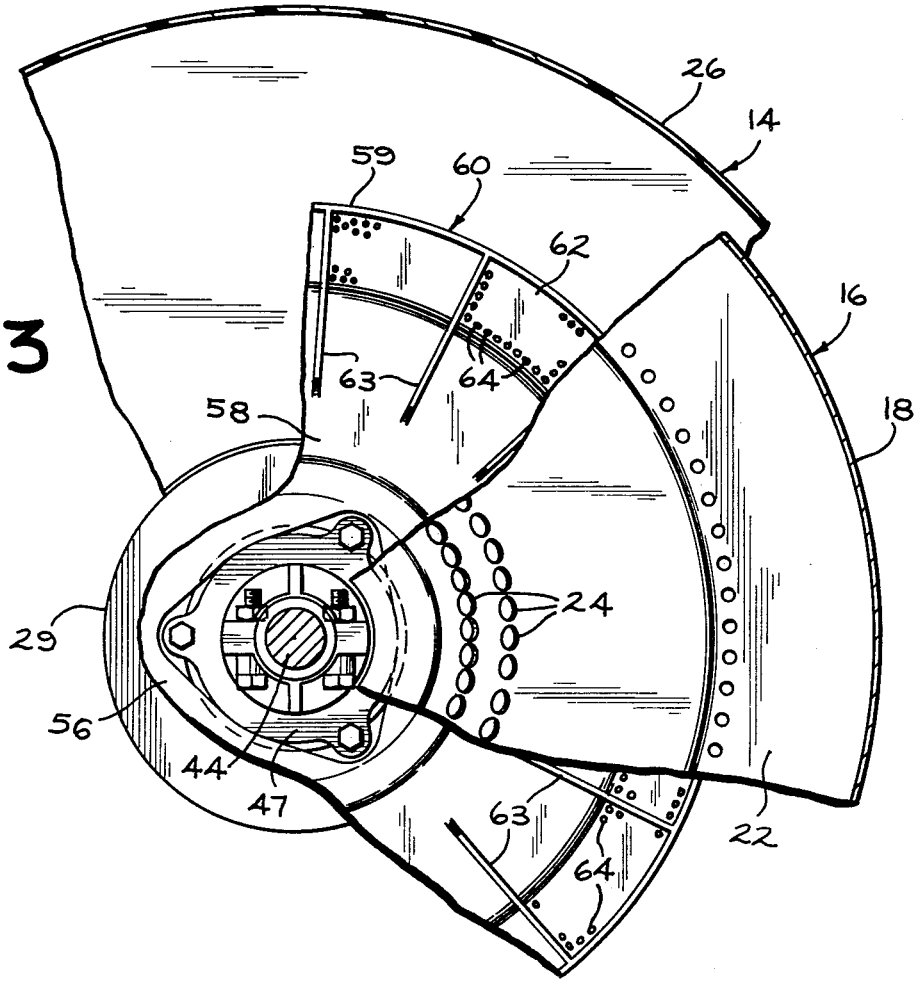
FIG. 3 is a fragmentary plane view taken along line 3—3 of FIG. 2 clothes basket and filter arrangement of the present invention.
Figure 2:
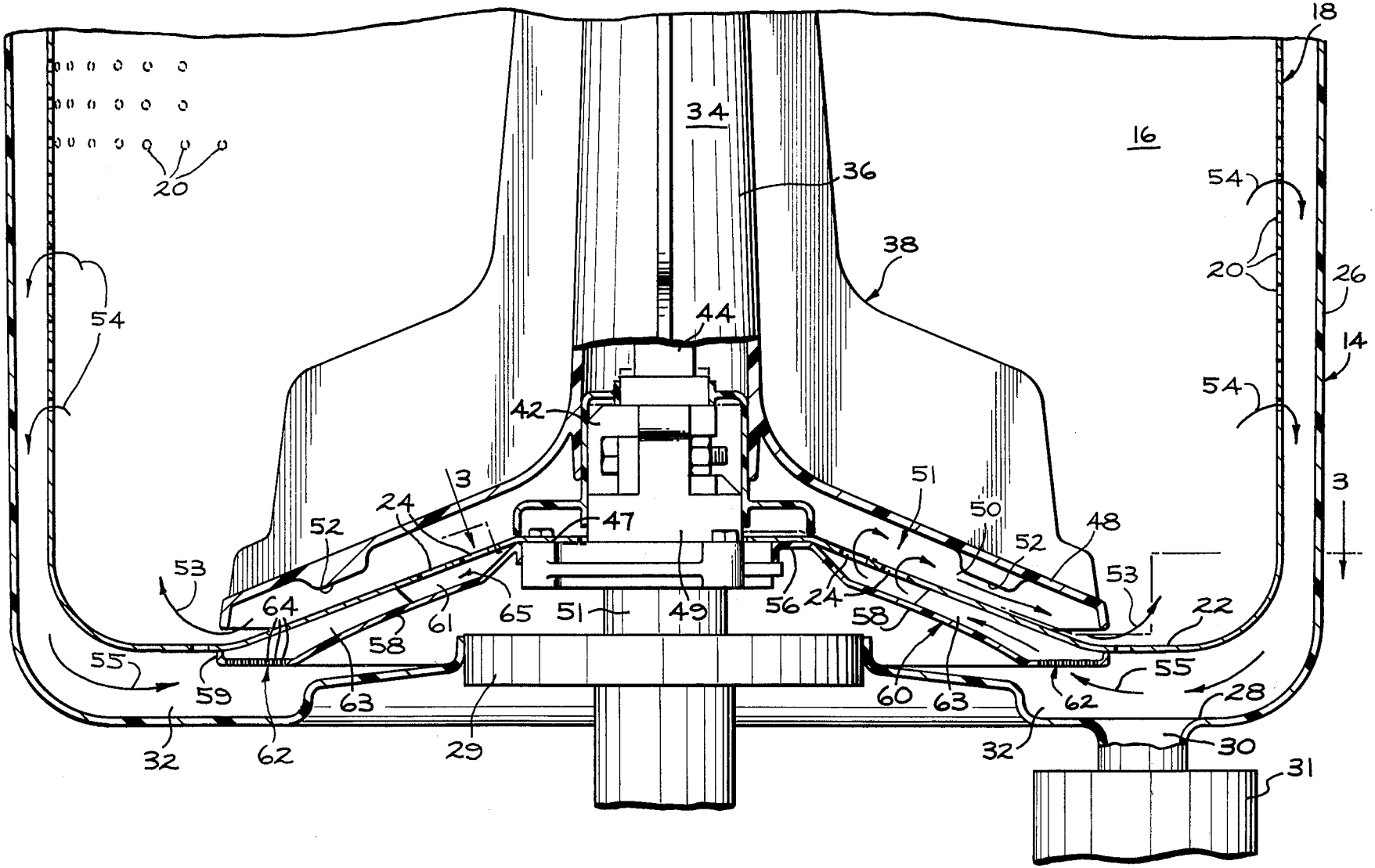
FIG. 2 is an enlarged elevational view in cross section taken substantially through the vertical axis of the machine.

Referring to FIG. 1, there is shown a vertical axis washing machine 10 of the vertical axis type which includes a cabinet 12. Within the cabinet 12 is disposed an imperforate stationary outer tub or casing 14. Within the imperforate tub 14 there is disposed a basket or receptacle 16 for receiving fabric articles, such as clothing, to be washed. As best seen in FIG. 2, the basket side wall 18 includes a plurality of apertures 20 for discharge of water during a centrifugal extraction or spinning portion of the operating cycle of the machine. The bottom wall 22 of basket 16 slopes upwardly from a low portion at the outer circumference of the side wall 18 toward the central vertical axis. A plurality of openings 24 (FIG. 3) are formed in the bottom wall 22 adjacent the center portion which, as will be explained hereinafter, function in recirculating liquid between the basket 16 and tub 14 during the wash operation. The tub 14 is composed of an imperforate side wall 26 and a generally imperforate and substantially horizontally disposed bottom wall 28 having a single drain opening 30 formed in a sump portion 32 of the bottom wall 28. The tub is mounted on a stationary support flange 29 arranged on the vertical axis. At the center of the basket 16 there is positioned a vertical axis agitator 34 which includes a vertical center post 36 and a plurality of vanes 38 extending outwardly from the central vertical post 36 thereof. The agitator vertical portion 36 is concentrically mounted about a center post 42, and is driven by an oscillating agitator drive shaft 44, by means of a drive motor 46.

The basket 16 is mounted on a flange 47 of a rotatable spin hub 49, and is driven by a drive sleeve 51 by means of the motor 46. During operation of the washing machine in the washing cycle, the agitator 34 driven by shaft 44 is first oscillated back and forth within the basket 16 to wash the clothes therein. Then, after a predetermined period of this washing action, the basket 16 driven by spin hub 49 is rotated at high speed to extract centrifugally the washing liquid and discharge it into the outer tub 14 for draining from the machine through the drain opening 30. Liquid from the drain 30 is carried from the machine by a pump 31 which may be energized during the extraction operation or a selected portion thereof. The cycle of the machine may be of the direct-into-spin operation with the pump 31 being operable during the entire extraction operation or the pump may be energized to drain a selected amount of liquid from the machine prior to the beginning of the extraction operation. The above described cycle may be repeated in carrying out a wash operation, depending on the fabric to be washed. The basket 16 and agitator 34 may be driven by any suitable means as the drive means forms no part of the present invention. However, by way of example, they are shown as driven by an electrically commutated reversible motor 46.

A skirt portion 48 of the agitator 34 is provided below the vanes 38 which extends outwardly and downwardly in spaced relationship with the bottom wall 22 of basket 16. The area 50 between skirt portion 48 and wall 22 forms an agitator driven pumping means 51 through which laundry liquid is pumped radially outwardly each oscillation of the agitator 34. The agitator pumping means 51 comprises radially extending pumping vanes 52 formed on the skirt portion 48 of the agitator 34. The vanes 52 are located radially outwardly of the openings 24. During the washing portion of the machine cycle, the pumping vanes 52 draw laundry liquid from the lower portion of tub 14 through openings 24, which are in effect the inlet openings of agitator driven pumping means 51, and is caused to flow radially outwardly through pumping area 50 by the centrifugal force imparted by the oscillating agitator 34.

Liquid flows out from under skirt 48, as at arrow 53, to enter the basket 16 and then flows outwardly through the holes 20 in the basket side wall 26, as at arrows 54, and downwardly past the sump portion 32 of the tub radially inwardly along the underside of the basket bottom wall 18, as at arrows 55, to return to the interior of the basket 16 through openings 24. As the laundry liquid passes in this liquid circuit, sand and other heavy dust particles or debris are generally deposited along the sump 32 of the tub 14. By the present invention, means are provided to insure that lint carried by this recirculating liquid is not redeposited on the articles being washed.

To this end, a filter means or element 60 is provided between the sloping bottom wall 22 of the basket 16 and the bottom wall 28 of the tub 14. The filter 60 includes a central portion 56 which is supported for rotation with the basket 16 on the flange 47 which, as stated above, also supports the basket 16.

The filter 60 is generally disc-shaped and includes the central portion 56 juxtapositioned relative to the lower wall 22, a body portion 58 which extends radially outwardly and downwardly in spaced relationship with the bottom wall 22, and a circumferentially disposed ring or wall portion 59 which extends upwardly to engage the lower end portion of the bottom wall 22 to form a pump area 61 of a basket driven pump means 65. The spaced relationship defining area 61 between the filter 60 and bottom wall 22 is maintained by a plurality of radially disposed vanes 63 which are part of the pump means 65, and, as will be explained below, serve to pump liquid outwardly during the extraction operation. The outer peripheral end portion of the filter 60 is formed with a circumferentially disposed flat filtering surface or portion 62 positioned generally beneath the outer edge of the skirt portion 48 of agitator 34 and below the lowermost outer portion of basket 16. The flat filtering surface 62 in effect is in a plane substantially perpendicular to the vertical axis of the machine and generally parallel with sump area portion 32 of the bottom wall 28 of tub 14. A plurality of apertures or filtering openings 64 are formed in the flat portion 62 which are substantially parallel to the vertical axis of the machine. The apertures 64 are spaced to maintain the integrity of the relatively flat surface of filtering surface 62 and are dimensioned to permit the free flow of liquid while preventing lint from being carried therethrough by the recirculating liquid. The radially disposed outer wall portion 59 and the central portion 56 which engage the bottom wall 22 of the basket 16 insure that all of the recirculating liquid from the outer tub 14 must flow through the apertures 64.

In the operation of the washing machine during the wash cycle with the agitator 34 oscillating, the pumping vanes 52 in area 50, as explained above, pump liquid radially outwardly along the bottom wall 22, then upwardly and out through the openings 20 in the side wall 18 of the basket 16 into the sump portion 32. From the sump area, all of the liquid then flows through the filtering openings 64 into the pumping area 61 and back through the openings 24 in the bottom wall 22 of the basket 16 to repeat the cycle. Any lint suspended in the circulating liquid impinges on and is retained against the outside surface of filtering surface 62 between the filter openings 64, thus preventing the lint from being redeposited on the laundered articles.

In operation, when the washing machine proceeds into the spin portion of the cycle spinning the basket 16 and thus the filter 60, the basket driven rotating vanes 63 provide a pumping action opposing flow from the tub through the apertures 64 and inwardly through the openings 24 into the basket and, accordingly, there is no flow of liquid into the basket through openings 24 during the extraction operation. As the water level in the basket decreases, the pumping action of the vanes 63 causes an increased flow outwardly from the basket, through openings 24 and apertures 64 into the tub 14. Thus, the pumping means 65 comprising the rotating filter 60 and pumping vanes 63 prevents sediment and debris which may have accumulated in the sump area 32 from returning to the basket 16. This pumping action of the rotating vanes 63 driven by rotation of basket 16 also causes a backflushing of liquid through the apertures 64 which will remove any lint trapped in the apertures and allow it to be drained from the machine with the liquid. While this backflusing of liquid through the apertures 64 does in fact remove lint entrapped in the apertures, there may remain some lint caught on the filtering surface 62, more specifically the flat surface area between the apertures 64.

By the present invention, lint adhering to the filtering surface is effectively removed therefrom during the extraction cycle. During the initial portion of the extraction operation, the horizontal orientation of the filtering surface 62 and its close proximity to the sump area 32 causes a shearing force between the spinning basket and the liquid in the sump area of the tub that effectively removes any lint that may be entrapped on filtering surface 62.

In summary, by the present invention a liquid filtering system is provided in which lint captured during the washing operation is cleaned from the filtering apertures by a backflushing action of liquid during the extraction operation, with the filtering surface being cleaned during the initial portion of the extraction operation.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A washing machine of the vertical axis type including an outer imperforate tub having a side wall and a bottom wall for containing a liquid;

a basket mounted in the tub on said vertical axis for containing articles to be washed and having a perforated side wall and lower wall sloping upwardly from a lower portion at the outer circumference of said side wall toward said central axis, said basket lower wall adjacent said bottom wall of the tub including circumferentially spaced openings being spaced from said vertical axis;

agitating means mounted in said basket on said vertical axis for rotation relative to said basket;

drive means connected to said basket for spinning said basket during a liquid extraction operation and for oscillating said agitating means during a washing operation;

a disc shaped filter means mounted for rotation with said basket including an imperforate portion extending from a central portion adjacent said vertical axis in contact with the lower wall of said basket to a body portion arranged in spaced parallel relationship with the lower wall of said basket and a circumferentially disposed wall portion extending upwardly to engage the lower wall of said basket, a relatively flat filtering surface disposed circumferentially on the peripheral end of said body portion being in a plane substantially perpendicular to said vertical axis and positioned between the outer lower portion of said lower wall and the bottom wall of the tub, said filtering surface including a plurality of openings being dimensioned for removing lint from liquid circulating therethrough during said washing operation and for causing lint to be removed from said relatively flat filtering surface by the shearing force between the spinning basket and the liquid in said tub during the initial portion of said extraction operation;

agitator driven pump means defined between said agitator and said lower wall of said basket, impelling vanes on said agitator located radially outwardly from said circumferentially spaced openings in said basket for causing liquid circulating during said washing operation to flow upwardly from said tub through said filtering surface and into said basket and outwardly through said circumferentially spaced openings to be returned to said tub, thereby preventing lint from returning to said basket during said washing operation; and basket driven pump means including liquid impelling vanes on said filter means disposed between said filter and said lower wall of said basket located radially outwardly from said circumferentially spaced openings defining a pump means for causing liquid to flow downwardly from said basket through said circumferentially spaced openings and said filtering means for backflushing and removing lint from said filtering surface during said extraction operation.

* * * * *